US007416229B2

(12) United States Patent
Stefanic

(10) Patent No.: US 7,416,229 B2
(45) Date of Patent: Aug. 26, 2008

(54) MOTOR VEHICLE LOCK

(75) Inventor: Josip Stefanic, Odenthal (DE)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 0 days.

(21) Appl. No.: 11/174,521

(22) Filed: Jul. 6, 2005

(65) Prior Publication Data

US 2007/0007774 A1 Jan. 11, 2007

(51) Int. Cl.
*E05C 3/16* (2006.01)
*E05C 3/06* (2006.01)

(52) U.S. Cl. ..... 292/216; 292/201; 292/DIG. 23

(58) Field of Classification Search ..... 292/216, 292/201, DIG. 23; 49/280
See application file for complete search history.

(56) References Cited

U.S. PATENT DOCUMENTS 1,949,850 A * 3/1934 Willard ..... 292/341.16
3,334,934 A * 8/1967 Sandor ..... 292/216
3,347,584 A * 10/1967 Johnstone ..... 292/198
4,395,064 A * 7/1983 Bellot et al. ..... 292/201
4,569,544 A * 2/1986 Escaravage ..... 292/216
5,020,838 A 6/1991 Fukumoto
5,238,574 A * 8/1993 Kawashima et al. ..... 210/652
5,934,717 A 8/1999 Wirths et al.
5,938,252 A * 8/1999 Uemura et al. ..... 292/201
6,422,615 B1 * 7/2002 Roos et al. ..... 292/216
2004/0227358 A1 * 11/2004 Kachouh ..... 292/216

FOREIGN PATENT DOCUMENTS

DE 20016292 U1 * 12/2000

* cited by examiner

*Primary Examiner*—Patricia Engle
*Assistant Examiner*—Alyson M Merlino
(74) *Attorney, Agent, or Firm*—David S. Safran

(57) ABSTRACT

A motor vehicle lock with a latch and a ratchet, the latch being movable out of a fully latched position into a release position and vice versa, and the ratchet being movable out of an engagement position which keeps the latch in the fully latched position into a raised position which releases the latch, and optionally, into an overtravel position and vice versa. To achieve reliable opening, a forced opening mechanism is provide which is actuated by the movement of the ratchet or of the drive which moves the ratchet, and the ratchet or the drive causes the forced opening mechanism to positively engages the latch or an element which is dynamically connected to the latch so as to forcibly move the latch toward the release position.

8 Claims, 8 Drawing Sheets

MOTOR VEHICLE LOCK

BACKGROUND OF THE INVENTION

1. Field of the Invention

This invention relates to a motor vehicle lock with a latch and a ratchet, the latch being movable out of a fully latched position into a release position and vice versa, the ratchet being movable out of an engagement position which keeps the latch in the fully latched position into a raised position which releases the latch, and optionally, into an overtravel position and vice versa. Preferably, a motorized drive being provided for movement of the ratchet. The motor vehicle lock is especially suited as a rear hatch lock, but can also be used as a side door lock, rear door lock or hood lock.

2. Description of Related Art

A known motor vehicle lock (U.S. Pat. No. 5,020,838 A) has a ratchet and a latch which are connected to one another by means of a spring. The spring is arranged such that the ratchet is loaded in the direction of its engagement position. When the ratchet is moved by means of a motorized drive into its raised position, the spring loads the latch in the direction of the release position of the latch. This is intended to ensure that the latch is reliably opened. However, opening is not reliable, for example, when the door is iced over and the motor vehicle door therefore is not pressed by the door seal in the direction of the open position. The latch is then held by the lock pin in its fully latched position and the ratchet is moved back into the engagement position as a result of the spring force. Thus, under certain circumstances, reliable opening is not possible.

In order to prevent the ratchet from re-engaging the engagement position after completed lifting of the ratchet, providing a mechanical lever, a so-called snow load lever, on the motor vehicle lock is known. The snow load lever engages relative to the ratchet when the raised position of the ratchet is reached, such that the ratchet is held in the raised position until the latch has reached its release position. In this position of the latch, the snow load lever is pivoted free of the ratchet so that it is operable again with respect to the fully latched position of the latch. This mechanical technology is proven and advantageous since it solves the problem of a hatch or a door which does not open itself, for example, when loaded by snow, when the reset force of the seal is not enough, or when the seal is frozen solid. However, the additional lever constitutes an additional cost factor and additional risk factor (jamming, breaking, etc.).

The re-engagement of the ratchet with the engagement position can be precluded using purely control engineering for ratchets which are driven by a motor. To do this, it is necessary to scan the motion of the latch by means of microswitches until the release position is reached. However, this version is both expensive and fault-susceptible.

Moreover, a motor vehicle lock is known (U.S. Patent Application Publication No. 2004/0227358 A1, which is commonly owned with the present application) in which the force or work which is to be applied for release of the latch is minimized. This is achieved in that the ratchet interacts with ratchet kinematics and the latch is not held directly by the ratchet in its fully latched position, but indirectly by means of the ratchet kinematics. In this motor vehicle lock, there are no special provisions for reliable opening when the door is iced up. The disclosure of U.S. Patent Application Publication 2004/0227358 A1 is hereby incorporated by reference.

The motor vehicle lock for multi-catch motor vehicle locks (U.S. Pat. No. 5,934,717 A) which forms the starting point of this invention calls for a ratchet which can return to the engagement position only after the latch moves into the release position. This is accomplished in that the ratchet with the latch in the preliminary catch position has an overlap and the ratchet is made such that it can return again to the engagement position by its motorized drive only after the latch is shifted into the release position. Here, the overlap between the latch and ratchet is made such that scanning of the ratchet by sensors can be omitted. However, the disadvantage here is that this concept can only be used for multi-catch motor vehicle locks. Moreover, when the doors are frozen tight, an increased force must be applied by the operator to open a motor vehicle door.

SUMMARY OF THE INVENTION

The primary object of the present application is to devise a motor vehicle lock in which opening can be reliably and easily accomplished at any time.

This object is achieved in a motor vehicle lock of the initially mentioned type by the latch having a forced opening mechanism which is actuated by the movement of the ratchet or of the drive which moves the ratchet, and by the ratchet or the drive by means of the forced opening mechanism, at least on the last part of the movement of the ratchet in the direction of the overtravel position and/or during continued movement of the drive after the ratchet reaches the raised position, positively engaging the latch or an element which is dynamically connected to the latch so as to forcibly move the latch in the direction of the release position.

The underlying idea of this invention is to provide a forced opening mechanism for the latch which is matched to the motion of the ratchet and is positively engaged with the latch itself or with an element which is dynamically coupled to the latch on the last part of the movement of the ratchet into the overtravel position and/or during continued movement of the drive of the ratchet after reaching the raised position of the ratchet so that the latch is moved by the forced opening mechanism in the direction of the release position.

In this way, when the ratchet is raised, the latch in any case is forcibly moved a short distance in the direction of the release position so that an initial blockage which may be present, such as, for example, by snow or ice, is effectively overcome. This teaching proceeds from the finding that at least after an initial "breaking loose" of the latch out of the fully latched position, further opening of the motor vehicle door or hatch is easily possible, but at least it is ensured by the overlapping of the latch with the path of motion of the ratchet that the ratchet, in any case, no longer returns to the engagement position. The motor vehicle door or hatch can in any case be opened by hand even if it should be loaded by snow or in some other way.

So that, after first overcoming the blockage, it is ensured that the ratchet does not engage the engagement position again and thus subsequently enable unwanted re-engagement, the motor vehicle lock advantageously has a holding means which prevents the latch from being pressed back into the fully latched position after release by the ratchet.

So that closing of the motor vehicle lock is ensured in the same way as opening, it is advantageous if the forced opening mechanism for the latch is moreover a forced closing mechanism for the ratchet which moves the ratchet in the direction of its engagement position when the latch is moved from the release position in the direction of its fully latched position.

Preferably, the forced opening mechanism has a driver which ensures positive connection to the latch or to one element which is dynamically coupled to the latch. A driver is especially suited in this respect since it can be easily, and thus economically, integrated into the motor vehicle lock, and at the same time, enables good transmission of force to the latch.

In one alternative embodiment, the forced opening mechanism has a lever, especially on the ratchet, which can be positively engaged to the ratchet kinematics. In this case, it is preferable that the actuating forces for the ratchet are kept low by the ratchet kinematics.

It is especially advantageous if the forced opening mechanism cannot be positively engaged to the latch itself, but to an element which is dynamically coupled to the latch. In this way, it is possible to arrange, between the ratchet and the latch, ratchet kinematics by which the force which is to be applied for release of the latch is minimized (as described in U.S. Patent Application Publication No. 2004/0227358 A1). Since in a motor vehicle lock with low actuating forces the action of icing over of the motor vehicle door is especially problematic, forced opening is especially advantageous here.

It is especially advantageous if the forced opening mechanism is located on the ratchet itself. Driving is then accomplished in an especially simple manner and there is always matching between the forced opening mechanism and the ratchet by the corresponding positioning on the ratchet.

The invention is explained in detail below using the drawings with reference to the detailed description below and from which various embodiments and developments as well as other features, properties, aspects and advantages of the invention will become apparent at the same time.

DETAILED DESCRIPTION OF THE INVENTION

Figure 1:
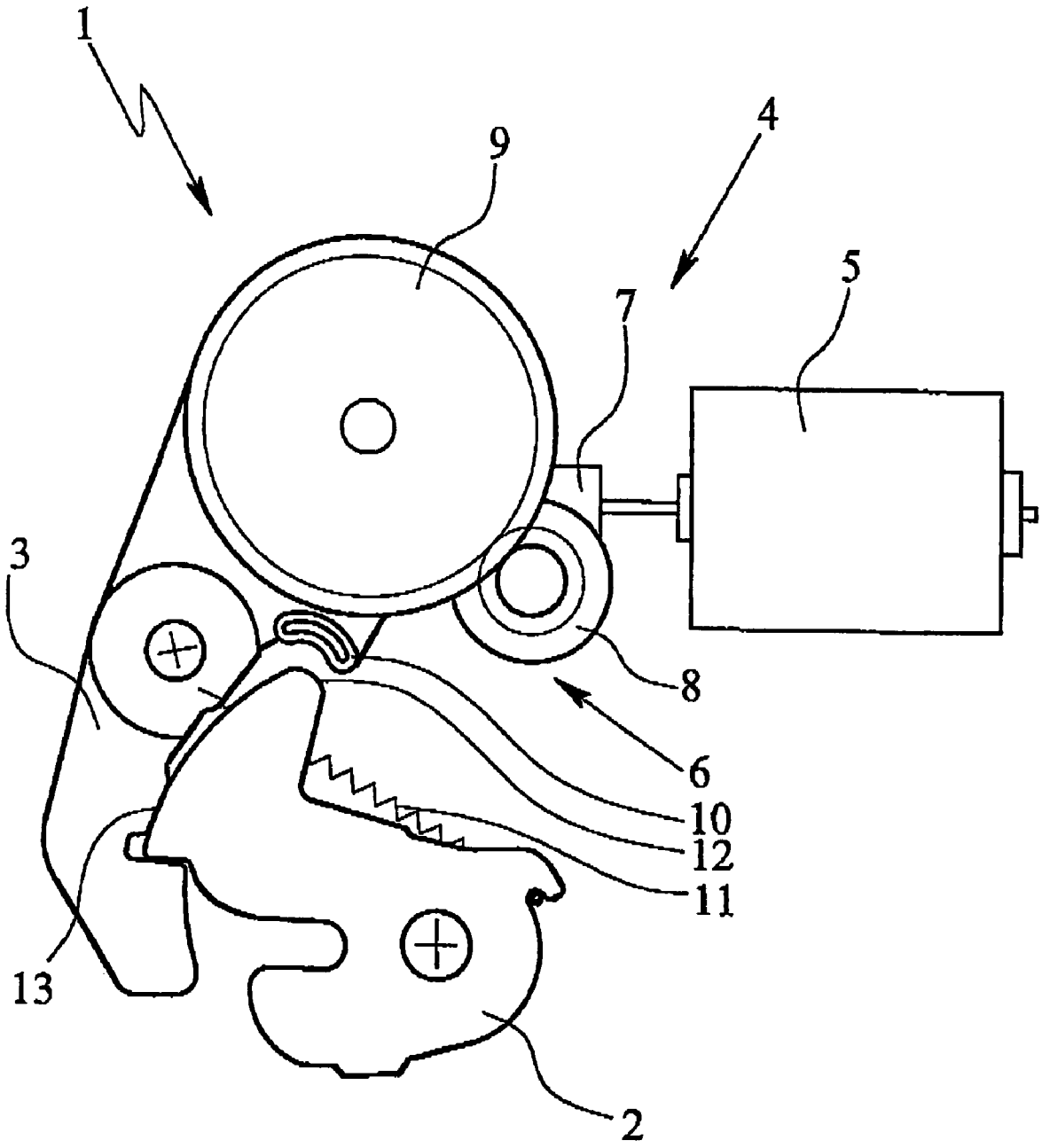
FIG. 1 is a schematic representation of a motor vehicle lock with the latch in the fully latched position.
Figure 2:
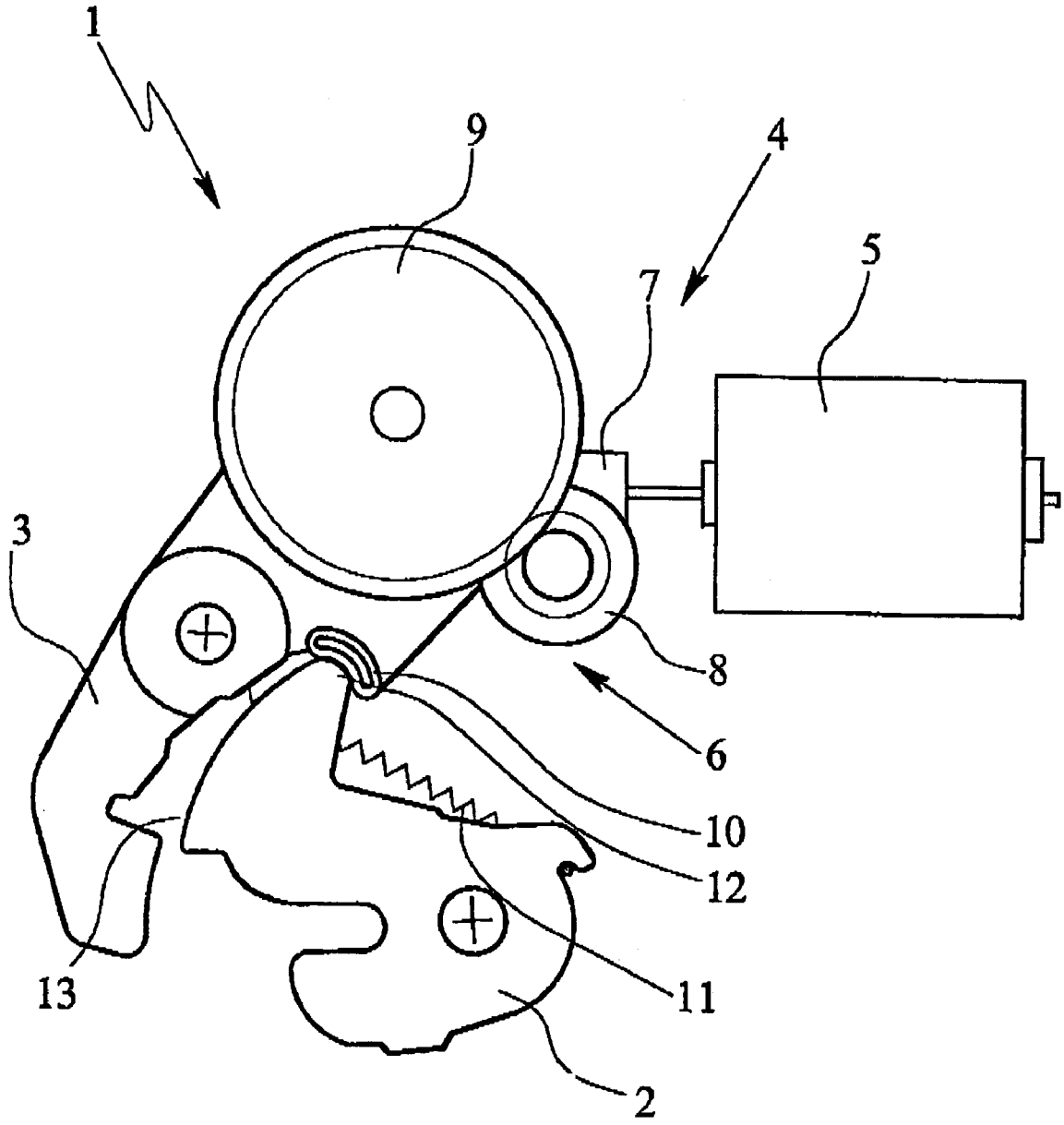
FIG. 2 shows the motor vehicle lock from FIG. 1 with the latch moved in the direction of the release position.

FIG. 1 shows a motor vehicle lock 1 with a latch 2 and a ratchet 3. The latch 2, which is made here preferably as a rotary latch, can be moved out of the fully latched position (FIG. 1) into a release position (FIG. 3) and vice versa. The ratchet 3 has an engagement position (FIG. 1) in which it keeps the latch 2 in the fully latched position. In addition, the ratchet 3 has a raised position (FIG. 3) in which the latch 2 is released. On the path from the engagement position into the raised position, the ratchet 3 passes an overtravel position which is shown in FIG. 2. In this overtravel position, the ratchet 3 is raised further than in the raised position so that the latch 2 is released with a certain distance between the catch projection on the ratchet 3 and the catch projection on the latch 2. The overtravel of the ratchet 3 which is implemented in this way is preferably used here for forced opening of the latch 2.

In the embodiment shown here, the movement of the ratchet 3 out of its engagement position into the raised position is accomplished by means of a motorized drive 4. Instead of the motorized drive 4, movement can also take placed manually, therefore mechanically. It can also be provided that the motorized drive 4 is effective only for movement from the engagement position into the raised position and the overtravel position. The movement from the raised position back into the engagement position can then be accomplished in some other way, for example, by a spring.

The motorized drive 4, here, preferably has an electric motor 5 and gearing 6. The gearing 6 has a worm 7 and several gears 8, 9 which are arranged such that the ratchet 3 can preferably be moved from the engagement position into the raised position. It is not detectable in FIG. 1 that, for this purpose, on the bottom of the gear 9, there is a driver which engages a guide which likewise lies underneath the gear 9 on the ratchet 3. However, this is the operating principle of the prior art, for example, from U.S. Pat. Nos. 5,020,838 and 5,934,717. Reference should be made thereto. Instead of the electric motor drive, there can also be a pneumatic or a hydraulic drive.

Furthermore, the motor vehicle 1 has a forced opening mechanism 10 with motion which is matched to the motion of the ratchet 3. The forced opening mechanism 10, here, preferably is arranged and is coupled to the motorized drive 4 such that it positively engages the latch 2 as soon as the ratchet 3 has released the latch 2. Further motion of the motorized drive, which also moves the ratchet 3 into its overtravel position (FIG. 2), leads to the forced opening mechanism 10 forcibly moving the latch 2 in the direction of the release position of the latch 2. The movement of ratchet 3 from the raised position into the overtravel position is thus part of the motion which is effective with respect to the forced opening mechanism 10 on the latch 2.

However, it is not absolutely essential to the invention that the ratchet 3 have an overtravel position. The motion which leads to the forced opening mechanism 10 positively engaging the latch 2 or an element which is dynamically coupled to the latch 2 can also be the continued motion of the drive 4 of the ratchet 3 after the raised position of the ratchet 3 has been reached. The ratchet 3 can remain in its raised position in this case.

Figure 3:
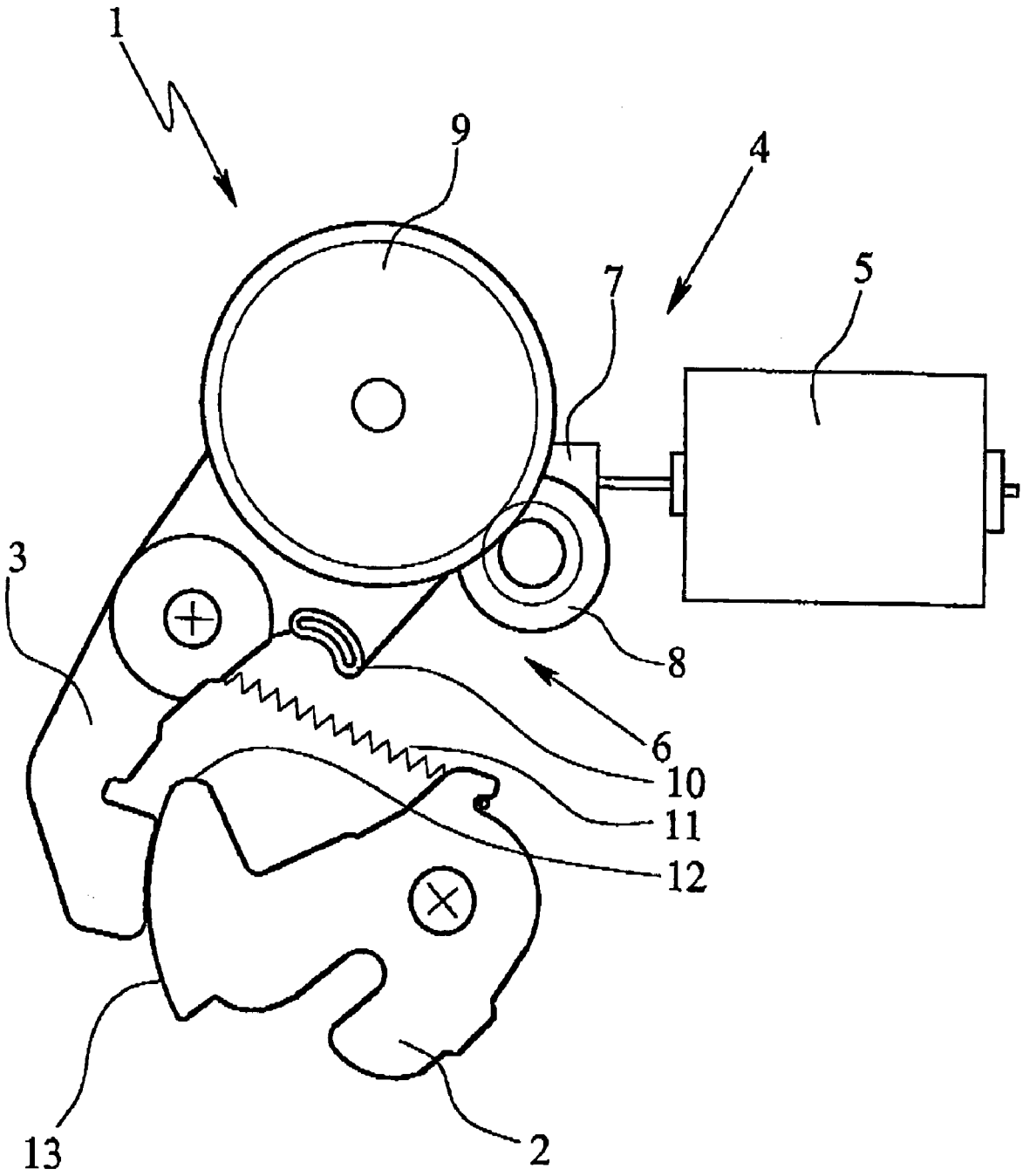
FIG. 3 shows the motor vehicle lock from FIG. 1 with the latch now in the release position.
Figure 8:
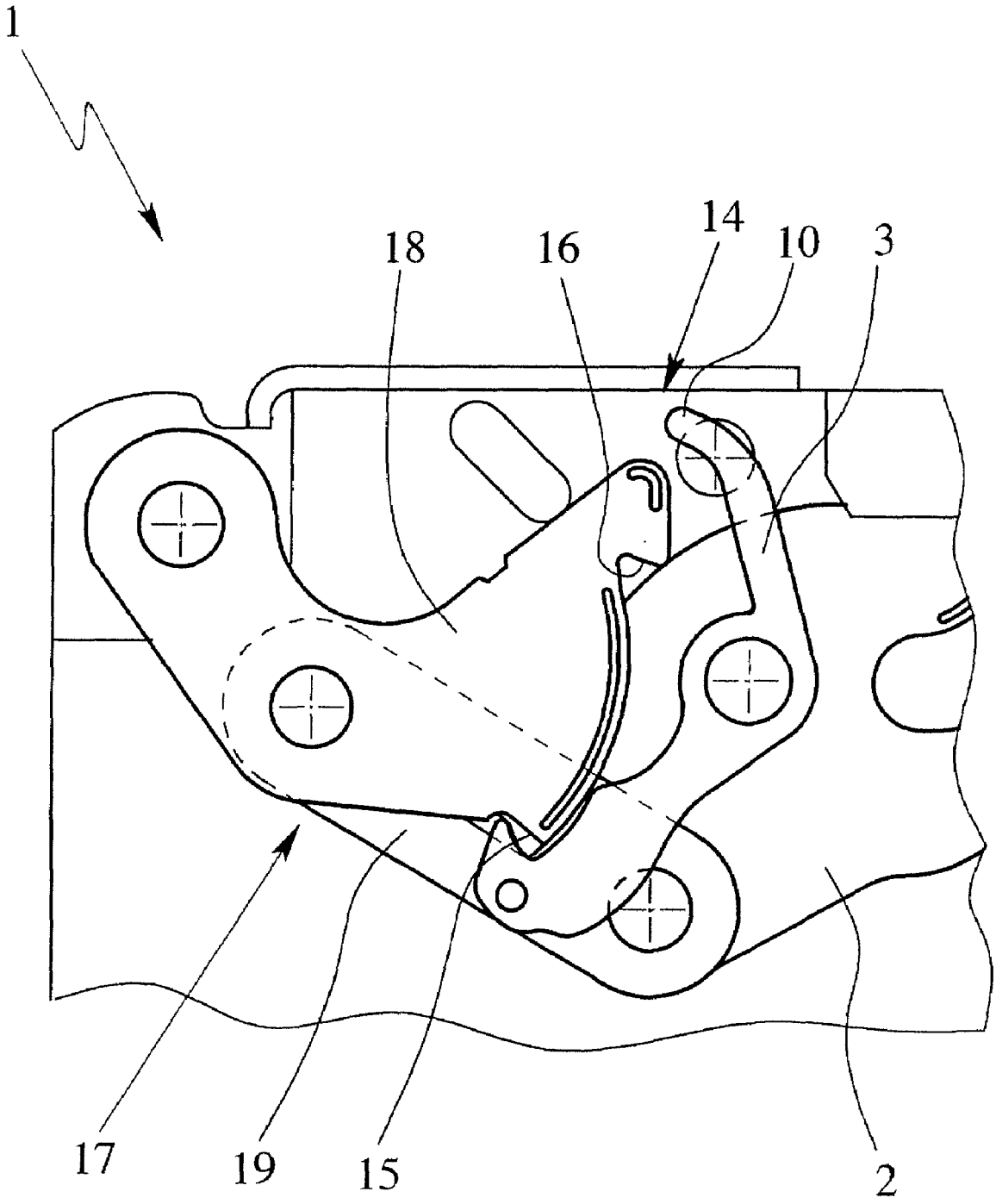
FIG. 8 shows the motor vehicle lock with the latch moved relative to the ratchet and ratchet kinematics into the fully latched position.

Since, when the motor vehicle door closes, the ratchet 3 is conventionally shifted into its overtravel position which is shown in FIG. 2, the forced opening movement mechanism 10, when the latch 2 is moved from the release position of FIG. 3 back into the fully latched position of FIGS. 1 & 8 in the opposite direction from the above described opening action, the interaction between the opening movement mechanism 10 and the latch is reversed. As a result, the latch 2 positively engages the forced opening mechanism 10. When the forced opening mechanism 10 is located on the ratchet 3 or is dynamically coupled to it, the ratchet 3 is moved, by continued movement of the latch 2 toward the fully latched position (FIG.8) in contact with the forced opening mechanism 10, in the direction of the engagement position so that the forced opening mechanism 10 is also used here as a forced closing mechanism and thus ensures engagement of the ratchet 3 in the engagement position.

In addition, the motor vehicle lock 1 has a holding means 11 which prevents the latch 2 from being pressed back into the fully latched position after release by the ratchet 3. The holding means 11 is preferably made as a spring here which loads the latch 2 in the direction of the release position. This ensures that the latch 2 does not return again by itself, i.e., due to loading by the snow lying on the hatch or the like, into its fully latched position. Moreover, the spring makes it possible for the latch 2, after overcoming the initial blockage, to be moved by means of the forced opening mechanism 10 into the release position.

The ratchet 3 is likewise assigned a spring which loads the ratchet 3 in the direction of its engagement position. In the embodiment shown here, the holding means 11 for the latch 2 and the spring for the ratchet 3 are the same spring. However, different elements can also be used.

Here, the forced opening mechanism 10 is made as a driver which interacts with a counterpart 12 on the latch 2. The counterpart 12 is a contact surface with which the driver makes positive contact, by which the latch 2 is moved in the direction of the release position. The forced opening mechanism 10 can have, instead of a driver, also a lever, a toggle lever mechanism, a control cam, a sheathed cable, a gear or the like. What is important here is simply that the forced opening mechanism 10 is matched to the motion of the ratchet 3, and adapted thereto, positively engages the latch 2.

In the embodiment shown here, the forced opening mechanism 10 is located on the ratchet 3 itself. Thus, matching between the motion of the ratchet 3 and the motion of the forced opening mechanism 10 is ensured in an especially simple manner. However, the forced opening mechanism 10 can also be located on or in another part of the lock mechanism. It is also be possible for the forced opening mechanism 10 to be driven at least indirectly by the motorized drive 4 of the ratchet 3, but it should not have its own drive.

Moreover, the motor vehicle lock 1 has a holding means 13 which prevents the ratchet 3 from re-engaging its engagement position out of its raised position as long as the latch 2 has not been moved back into the fully latched position. The holding means 13 is provided here as a contact surface on the latch 2 against which the ratchet 3 rests under the spring force of the spring 11, which also prevents re-engagement of the ratchet 3.

The embodiment illustrated here shows a motor vehicle lock 1 with only one closed position, specifically the fully latched position. The teaching of the invention can, however, be used equally well for multi-catch motor vehicle locks.

In any case, the action of the forced opening mechanism 10 is then limited to the closed position, preferably the fully latched position.

Figure 4:
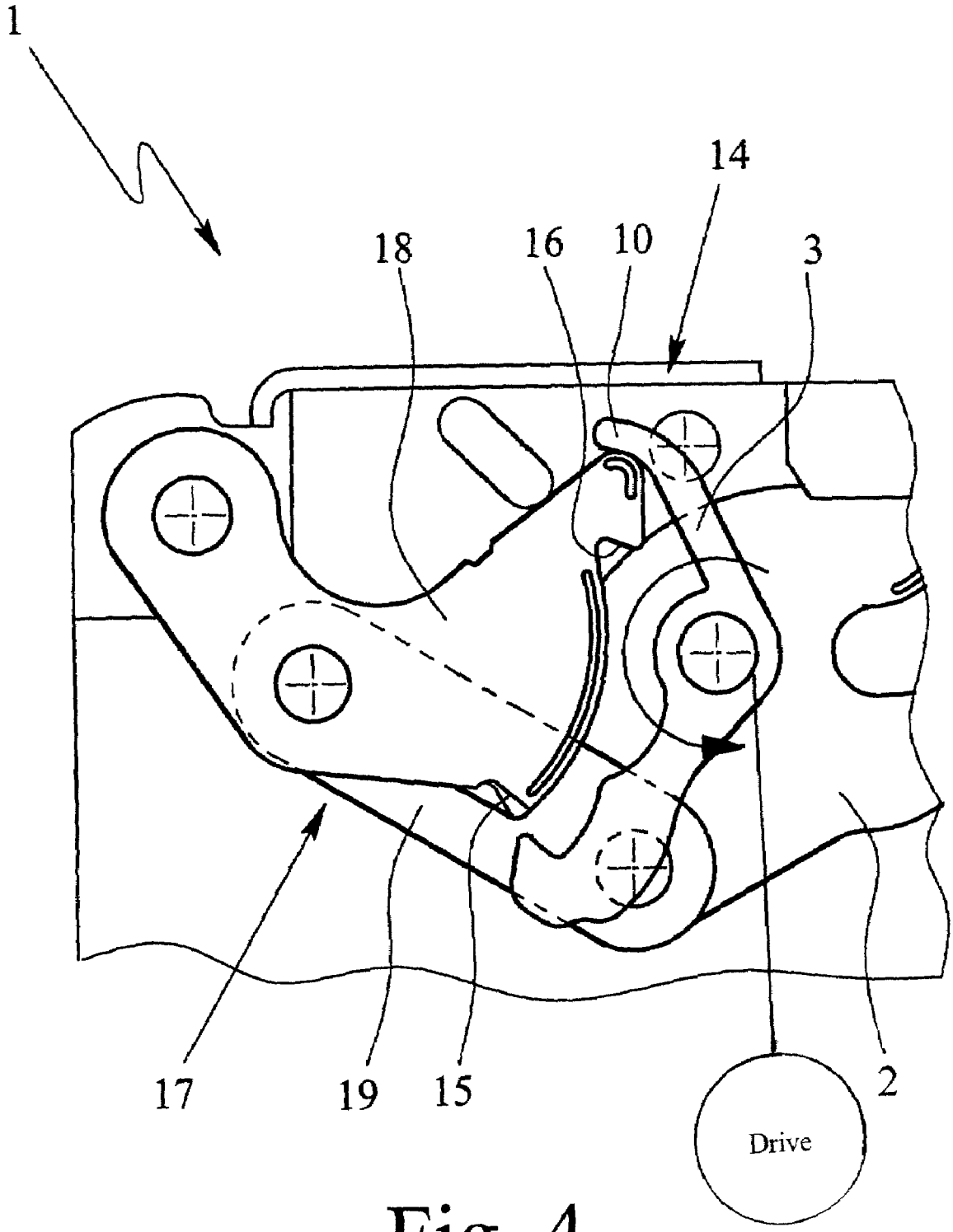
FIG. 4 is a schematic representation of another embodiment with the ratchet in a position between the raised position and the overtravel position.

FIG. 4 shows a multi-catch motor vehicle lock 1 in which the ratchet 3 is part of the ratchet arrangement 14. The ratchet arrangement 14 keeps the latch 2 with the main catch 15 in the fully latched position and with the preliminary catch 16 in the half-latched position. For this reason, the ratchet arrangement 14, in addition to the ratchet 3, has ratchet kinematics 17 in the form of two levers 18, 19. The main catch 15 and the preliminary catch 16 are located on the first lever 18 and the second lever 19 is used for coupling of the ratchet kinematics 17 to the latch 2. The operating principle of this motor vehicle lock 1 is already known from U.S. Patent Application Publication No. 2004/0227358 A1, to which reference is made again in this respect, having already been incorporated by reference. Preferred design versions of this prior art should also preferably be used in combination with the invention described here.

Here, the ratchet arrangement 14 preferably has a holding position in which the latch 2 is held in the fully latched position (FIG. 8). In this holding position, the ratchet kinematics 17 are blocked by the ratchet 3. The movement of the latch 2 out of the fully latched position in the direction of its release position (FIG. 7) is possible in this respect only when the ratchet 3 is moved into its raised position (rotated counterclockwise from the position shown in FIG. 4) with respect to the ratchet kinematics 17, which are dynamically coupled to the latch 2. With the movement of the latch 2 out of the fully latched position in the direction of the release position, the ratchet kinematics 17 are also moved out of the holding position in the direction of the release position.

Figure 6:
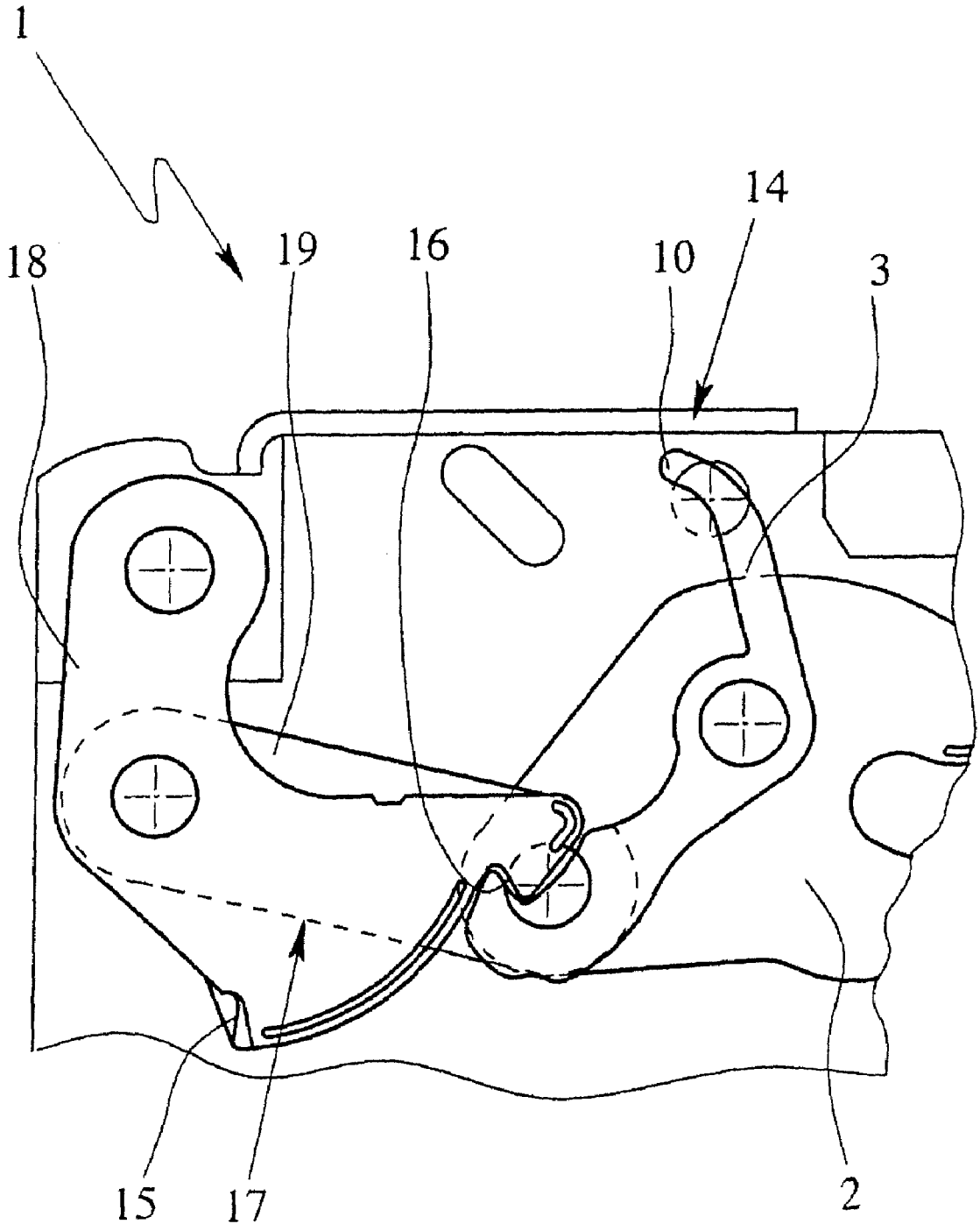
FIG. 6 shows the motor vehicle lock from FIG. 4 with the latch moved relative to the ratchet and ratchet kinematics into the pre-catch position.
Figure 7:
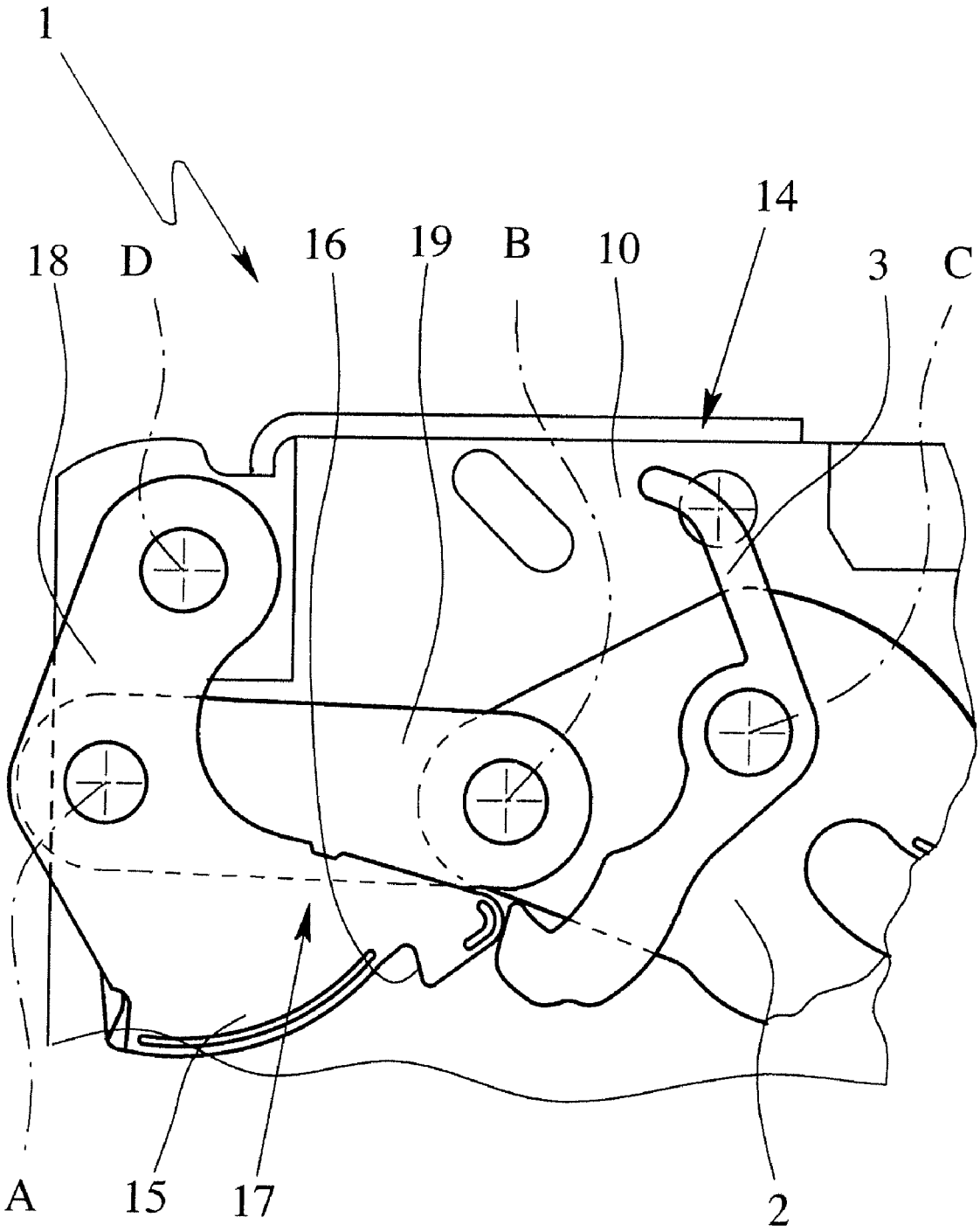
FIG. 7 shows the motor vehicle lock with the latch moved relative to the ratchet and ratchet kinematics into the release position.

The ratchet 3 has the forced opening mechanism 10, here in the form of a lever arm which is located on the ratchet 3. The forced opening mechanism 10, in the overtravel position of the ratchet 3, is positively engaged with a counterpart surface of the first lever 18 of the ratchet kinematics 17 and moves the first lever 18 such that the ratchet kinematics 17 moves the latch 2 in the direction of its release position (FIG. 7). The first lever 18 acts here as an element which is dynamically coupled to the latch 2 and which positively engages the forced opening mechanism 10. When the latch 2 is moved out of the pre-catch position (FIG. 6) into the release position, the forced opening mechanism 10 is not effective.

Figure 5:
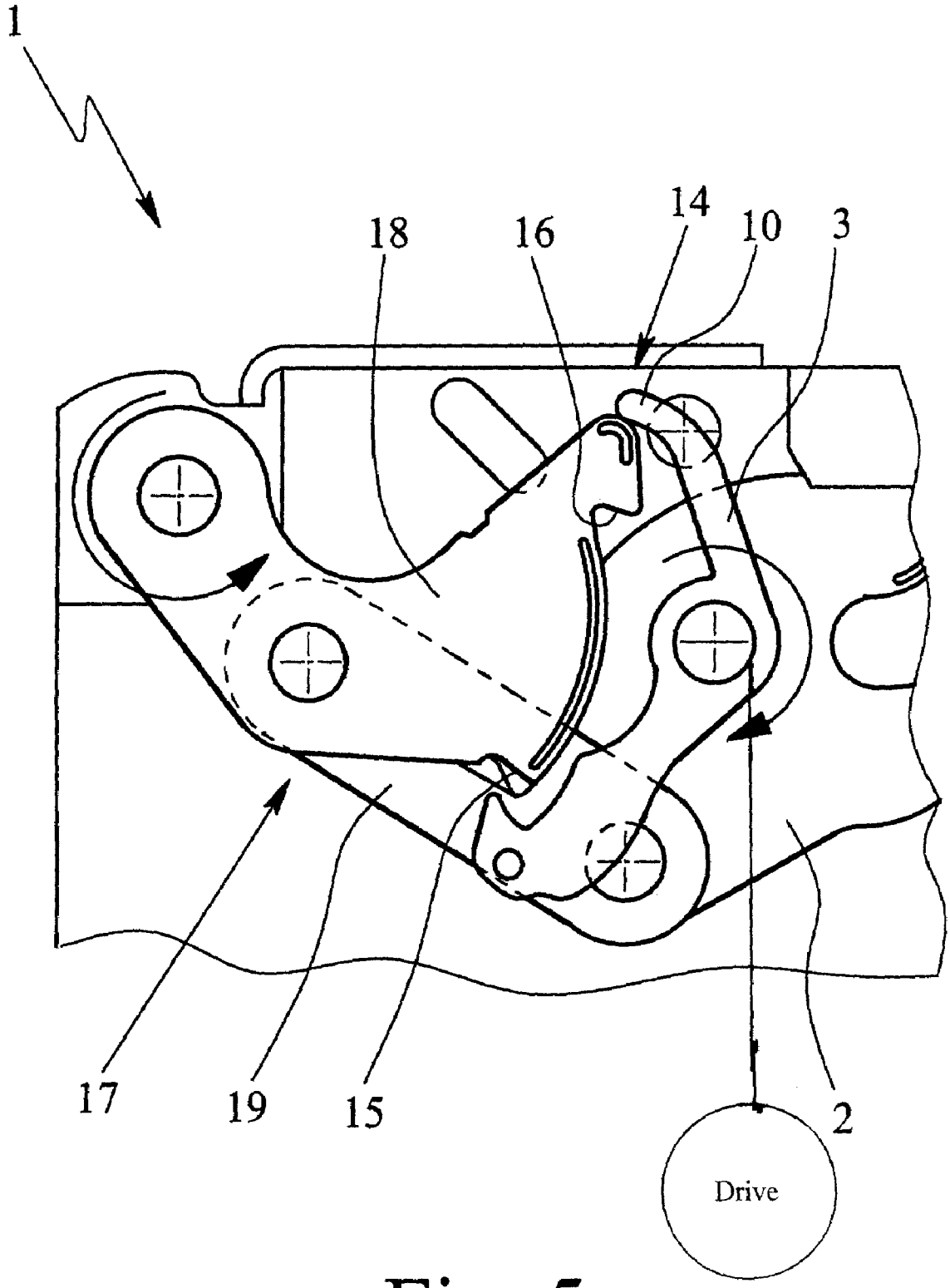
FIG. 5 shows the motor vehicle lock from FIG. 4 with the latch in the position between the raised position and the engagement position.

The forced opening mechanism 10 is also used here preferably as a forced closing mechanism (FIG. 5) by the forced opening mechanism 10 being moved when the latch 2 is moved from the release position in the direction of the fully latched position by means of the ratchet kinematics 17 such that, in this way, the ratchet 3 is moved in the direction of its engagement position. This takes place by the lever 18 of the ratchet kinematics 17, when the latch 2 is being closed, positively engaging the forced opening mechanism 10 and by means of the forced opening mechanism 10 moving the ratchet 3 in the direction of its engagement position.

What is claimed is:

1. Motor vehicle lock, comprising:

a latch, the latch being movable out of a fully latched position into a release position and vice versa, a ratchet, the ratchet being movable out of an engagement position which keeps the latch in the fully latched position into a raised position which releases the latch, the ratchet being part of a ratchet arrangement having ratchet kinematics which are connected to the latch and are engageable with the ratchet, and wherein the ratchet includes a forced movement mechanism for the latch which is moved with movement of the ratchet, the forced opening movement mechanism being adapted to positively engage the ratchet kinematics so as to forcibly move the latch toward the release position;

wherein the ratchet arrangement is movable into at least a holding position and a release position, wherein the ratchet is adapted to keep the latch in the fully latched position in the holding position, wherein the ratchet kinematics are adapted to be moved by moving the latch out of the fully latched position toward the release position, and wherein, when the ratchet arrangement is in the holding position, the ratchet blocks movement of the ratchet kinematics via engagement with the ratchet kinematics and thus blocks the shifting of the latch.

2. Motor vehicle lock as claimed in claim 1, wherein the forced movement mechanism for the latch is a forced opening mechanism and also a forced closing mechanism for the latch.

3. Motor vehicle lock as claimed in claim 2, wherein the forced closing mechanism is actuatable by motion of the latch from the release position toward the fully latched position.

4. Motor vehicle lock as claimed in claim 1, wherein the forced movement mechanism is in the form of a lever or contains a lever portion which is adapted to positively engage the latch or an element which is dynamically coupled to the latch as soon as the ratchet is moved into the raised position which releases the latch, and as the ratchet continues to move, shifts the latch toward the release position.

5. Motor vehicle lock as claimed in claim 1, further comprising a counterpart surface which interacts with the forced movement mechanism so as to be drivable thereby, the counterpart being located on the latch or on an element which is dynamically coupled to the latch.

6. Motor vehicle lock as claimed in claim 1, wherein the forced movement mechanism is located on the ratchet.

7. Motor vehicle lock as claimed in claim 1, wherein the latch is a rotary latch.

8. Motor vehicle lock as claimed in claim 1, wherein the latch is a multi-catch latch and the forced movement mechanism is effective in the fully latched position.

* * * * *